United States Patent [19]

Buynak

[11] Patent Number: 4,559,531

[45] Date of Patent: Dec. 17, 1985

[54] COLOR VIDEO GENERATOR

[75] Inventor: William Buynak, Bayville, N.Y.

[73] Assignee: Chyron Corporation, Melville, N.Y.

[21] Appl. No.: 466,325

[22] Filed: Feb. 14, 1983

[51] Int. Cl.[4] ..... G09G 1/28

[52] U.S. Cl. ..... 340/703; 340/701; 358/260; 358/261

[58] Field of Search ..... 340/701, 703, 728, 729, 340/750; 358/260, 261; 382/56

[56] References Cited

U.S. PATENT DOCUMENTS

| | | | |
|---|---|---|---|
| 3,739,085 | 6/1973 | Rosen et al. | 358/261 |
| 4,057,834 | 11/1977 | Nakagome et al. | 358/261 |
| 4,101,934 | 7/1978 | Fukuoka | 358/261 |
| 4,233,601 | 11/1980 | Hankins et al. | 340/703 |
| 4,486,784 | 12/1984 | Abraham et al. | 358/261 |

OTHER PUBLICATIONS

IBM Technical Disclosure Bulletin, vol. 16, No. 3, Aug. 1973, "Data Compression for Raster Display", W. C. Cook et al., pp. 928–929.

*Primary Examiner*—Gerald L. Brigance

*Attorney, Agent, or Firm*—Roberts, Spiecens & Cohen

[57] ABSTRACT

A video display system has a color display driven by a color generator for generating multicolor segments on a multiline television raster of the display. In this system, a method controls the color and the length of the lines by serially generating an array of color bytes, each being of a first class or a second class, the period being indicated by the value of a particular bit position in the line. Each of the bytes of the first class is divided into a first field and a second field, the first field being a coded-combination of bits representing a color, the second field being a coded-combination of bits representing a length, while the second class has only one field, that representing a length. By examining the particular bit it is determined whether to change the color or extend the color for the distance indicated by the length value which for the second class can now be much greater than for bytes of the first class. There is also disclosed how to extend the color for horizontal lines as well as for frames.

5 Claims, 2 Drawing Figures

VIDEO DISPLAY SYSTEM VDS

INHIBIT GENERATOR IG

COLOR VIDEO GENERATOR

BACKGROUND OF THE INVENTION

This invention pertains to video generators and, more particularly, to such generators which generate color displays.

In such generators, it is possible to create color displays by controlling the colors to be generated along the lines of a conventional television raster. Such displays are associated with graphic generators as well as television signals which supplement conventional "live" pictures. In these generators, it has become the practice to digitally encode the colors as well as the run lengths along the horizontal lines of the raster. Heretofore, the coding was structured as a first word or byte indicating the color and a second word or byte indicating the length. The other possibility is to within a single word reserve a portion for the color information and the remainder for the length information. Such a scheme is inefficient when one realizes that most often the length of the element exceeds the length that can be represented by the word. For example, if the element length is two times the possible maximum length that can be defined by a word, it is necessary to use two words with each word, including both the color and one-half the length value. Furthermore, in many instances, it is possible that in any horizontal line of the raster the color may change only once for the whole sweep. If the color changes close to the start of the line, then it is necessary to transmit several words of the second color to fill out the line. There are other wasteful operations when a single color is to be displayed for the whole frame or major portions thereof.

BRIEF DESCRIPTION OF THE INVENTION

It is accordingly a general object of the invention to provide a method for encoding and displaying color representations on a video display which is highly conservative of memory space and equipment.

Briefly, the invention contemplates a video display system with a color display driven by a color generator for generating multicolored lines on a multiline television raster of the display. In such a system, the invention is directed to a method for controlling the color and the length of the lines. In the method, there is serially generated an array of code bytes wherein each code byte is of a first class or a second class, the class being indicated by the value of a particular bit position in the byte. Each of the bytes of the first class is divided into a first field and a second field. The first field is a coded combination of bits representing the color to be displayed (color field), and the second field is a coded combination of bits representing a distance or length of the scan line (length field). The second class has only one field and that field merely represents a length. When a code byte is received, the particular bit position is examined. If the value ofthe particular bit position indicates the first class, there is transmitted a representation of the first field to the color generator to change the color being displayed. The second field is transmitted to a timing means to generate a timing interval. This timing interval indicates the length of the line for that byte. However, if the value of the particular bit position indicates the second class, there is transmitted the sole field of the byte to the timing means to generate a time interval. At the end of either time interval, the next code byte is received from the array and the method is repeated for the new set of values.

Thus, it is seen that it is now possible to represent much longer lines of color.

It is a feature of the invention to sense for a particular unique coded combination of bits of a portion of a byte. When this unique coded combination of bits is received anywhere in the raster line, the color associated with the other field of the byte is generated for the remainder of the raster line without the calling up of further bytes.

It is a further feature of the invention that whenever a particular unique coded combination of bits is detected at the start of a raster on any line the color associated with the other field of the byte is continuously generated until the end of the frame.

BRIEF DESCRIPTION OF THE DRAWING

Further objects, the features and advantages of the invention will be apparent from the following detailed description when read with the accompanying drawing which shows, by way of example and not limitation, apparatus for performing the method of the invention.

IN THE DRAWING

Figure 1:
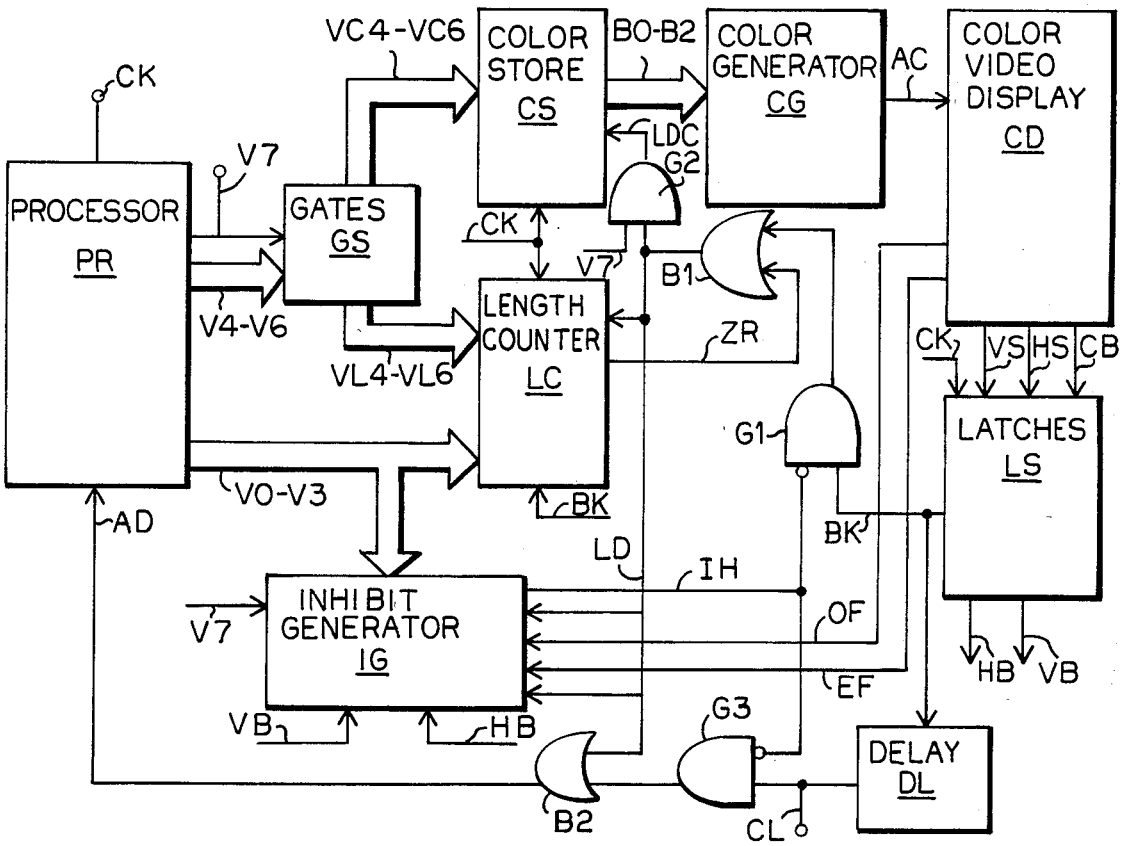
Figure 2:
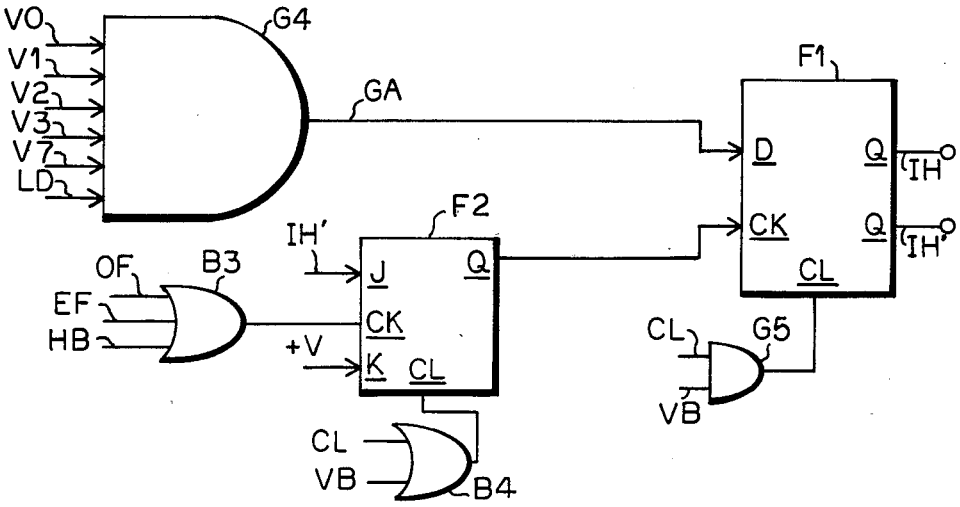

FIG. 1 shows a block diagram of a video display system employing the invention; and FIG. 2 shows a logic diagram of the inhibit generator of the system of FIG. 1.

DETAILED DESCRIPTION OF THE PREFERRED EMBODIMENT

In FIG. 1, the video display system VDS is centered around the processor PR which generates the bytes for driving the video display CD to generate or create frames for viewing. In general, the processor PR can be considered to be a frame buffer which emits a byte upon receipt of a step signal on the line AD. In addition, the processor PR generates clock signals for the apparatus on the line CK. While the bytes can take many forms, for the present example each byte will be considered to be eight bits wherein the most significant bit is a flag which indicates whether the byte is a one-field or a two-field byte. In particular, if the bit is a "one" represented by a signal on the line V7, the byte is a two-field byte wherein the bits on the lines V4–V6 of a multiline cable connected to the output of the processor PR represent one of eight possible colors. The second field of four bits has signals on the lines V0 to V3 which represent a length of a maximum of fifteen pixels. If the flag bit (signal on line V7) is a "zero",then the byte is a single field byte representing merely a length. The seven bits of length information will then be present on the lines V0 to V6 which represent up to 127 pixels of length.

The color video display CD can be of a conventional display which internally generates the television raster and associated therewith the numerous sync signals. These signals for the present invention are the vertical sync signal on line VS, the horizontal sync signal on line HS, the composite blanking signal on the line CB. This composite blanking signal actually is an OR-function of the vertical blanking signal and the horizontal blanking signal. In addition, the display will emit a first line of odd field pulse on the line OF and first line of even field pulse on the line EF. Furthermore, the display for the present invention merely must be receptive of an analog signal on the line AC to control the color circuits of the display for the desired color. While a single analog signal is being fed thereto, it should be realized that typically three such analog signals are fed to the display. The signals represent the intensity of the colors red, green and blue. The color generator CG can merely be a digital-to-analog converter which takes a three-bit binary number and converts it to a voltage whose amplitude is a function of the input binary value. For much greater versatility, the color generator can be of the form shown in U.S. Pat. No. 4,232,311 issued Nov. 4, 1980. The color store CS can merely be a three-position flip-flop register which is clocked by signals on line CK and loaded when a signal is present on the line BK. The length counter LC can merely be a seven position down counter which is loaded in parallel with seven bits (four on lines V0–V3 from the processor PR and three on lines VG4–VG6 from gates GS). The gates GS can be a multiplexor which connects the lines V4–V6 to the lines VC4–VC6 or the lines VL4–VL6 depending on the state of line V7. The inhibit generator IG which controls the feeding of bytes from the processor PR will hereinafter be more fully described.

In operation, whenever the processor PR receives a signal on line AD, it presents a byte on the lines V0–V7. If the byte is a two-field byte a bit will be present on line V7 which passes through AND-circuit G2 to give a signal on line LDC. At the same time, the signal on line V7 causes gates GS to connect the lines V4–V6 to the lines VC4–VC6 into the color store CS which feeds the color for loading generator CG. Concurrently therewith the four least significant stages of the length counter LC are loaded with the bits on lines V0–V3. Now the counter down counts the clock pulses on line CK. When the counter steps to zero it emits a pulse on line ZR which passes through OR-circuits B1 and B2 to line AD causing the delivery of another byte by processor PR.

Now assume the most significant bit is a zero (no signal on line V7). Then a seven bit length is loaded into counter LC because gates GS connect lines V4–V6 to lines VL4–VL6 which feed the three more significant counter stages and lines V0–V3 feed the four less significant counter stages directly. Now the counter downcounts a seven position number. When the counter again arrives at zero, the signal on the line ZR will cause the delivery of the next byte from the processor PR as described above. (Note the color remains the same as that for the previous byte since the field stored in color store CS was not changed.)

Whenever the byte received from the processor PR is a two-field byte and the length field has a value of zero, the length counter is loaded with zero immediately. Because there was a zero in the counter and a zero is being reloaded, there is no chance for the ZR pulse to be emitted and the stepping of the processor cannot occur. Thus the color associated with the color field is "painted" for at least the rest of the line. If this byte was not the first byre of the horizontal line, then at the end of the line the signal on the line BK passes through the AND-circuit G1 and the OR-circuit B1 to generate a pulse on line AD which now steps the processor at the start of the next horizontal line.

If at the start of a line, the byte that is emitted is a two-field byte whose length field contains zero, then the inhibit generator IG senses this fact and emits a pulse or a signal on the line IH to block the AND-circuit G1. The inhibit signal on line IH will stay on until the end of the frame. At that time, the signal on line VB associated with the vertical blanking resets the inhibit generator causing the disappearance of the signal on the line IH opening the AND-circuit G1 so that the processor PR can be stepped.

In particular, whenever a two-field byte is fed from processor PR it is tested in the inhibit generator IG (FIG. 2) to determine whether the byte has associated therewith a zero length.

This sensing occurs in the AND-circuit G4 which, in turn, will alert the flip-flop F1. If this two-field byte occurs at the start of a field which will be indicated by the presence of a signal on one of the lines OF, EF or HB at the OR-circuit B3, these signals indicating first odd field line, first even field line and horizontal blanking, respectively, are generated by the color video display CD and are conventional. If any one of these signals are present, then the flip-flop F2 is set to clock the flip-flop F1 which, in turn, will set, generating the signal on line IH. This signal will then block the AND-circuit G1 (FIG. 1) preventing any loading of bytes and most particularly, preventing any further transfers from the processor PR. At the end of the frame, the signals on the line CL and DB at the OR-circuit B4 and the AND-circuit G5 reset the flip-flops F1 and F2, terminating the signal on the line IH to permit further delivery of bytes.

While only one embodiment of the invention has been shown and described in detail, there will now be obvious to one skilled in the art many modifications and variations satisfying many or all of the objects of the invention but not departing from the spirit thereof.

What is claimed is:

1. In a video display system having a color display driven by a color generator for generating multicolored segments on a multiline television raster of the display, the method of controlling the color and length of the lines comprising the steps of serially generating an array of code bytes, each of said code bytes being of a first class or a second class, the class being indicated by the value of a particular bit position in the byte, each of the bytes of the first class being divided into a first field and a second field, the first field being a coded combination of bits representing a color, the second field being a coded combination of bits representing a length, the second class having only one field, said one field representing a segment length, receiving a code byte, examining said particular bit position of said received code byte, if the value of said particular bit position indicates the first class, transmitting a representation of the first field to the color generator to change the color being displayed and transmitting the second field to a timing means to generate a time interval, if the value of said particular bit position indicates the second class, transmitting the sole field of said byte to said timing means to generate a time interval, at the end of a generated time interval, receiving the next code byte of the array.

2. The method of claim 1 wherein, whenever the received code byte is one of said first class and whose second field is a unique coded combination of bits, disabling said timing means and receiving another code byte only at the start of the next raster line.

3. The method of claim 1 wherein, whenever the code byte received at the start of a raster line, is one of the said first class whose second field is a unique coded combination of bits, disabling said timing means and receiving another code byte only at the start of the next frame.

4. Apparatus comprising color video display means for the making of a color video display, color generator means to control the color of the display of said color video display means, color storage means coupled to said color generator means to control the same with respect to color, length counter means coupled to said color storage means to control the length of display of the color, processor means to put information into said color storage means and length counter means, said information being input in an array of code bytes, each of said code bytes being of a first class or a second class, the class being indicated by the value of a particular bit position in the byte, each of the bytes of the first class being divided into a first field and a second field, the first field being a coded combination of bits representing a color, the second field being a coded combination of bits representing a length, the second class having only one field representing a length, and means to selectively cause said bytes to be placed into said color storage and length counter means or into said length counter means only, based upon the class of the respective bytes.

5. Apparatus as claimed in claim 4 further comprising inhibit means to detect a value of zero in the length counter means and to extend the condition in the color storage means if a value of zero is detected in the length counter means.

* * * * *